US006644528B1

(12) United States Patent
Reitano

(10) Patent No.: US 6,644,528 B1
(45) Date of Patent: Nov. 11, 2003

(54) FAMILY OF PILL SPLITTERS AND METHOD OF MANUFACTURE

(76) Inventor: Carmen T. Reitano, 192 N. End Blvd., Salisbury, MA (US) 01952

( * ) Notice: Subject to any disclaimer, the term of this patent is extended or adjusted under 35 U.S.C. 154(b) by 0 days.

(21) Appl. No.: 10/248,043

(22) Filed: Dec. 12, 2002

(51) Int. Cl.[7] ..... B26F 3/00

(52) U.S. Cl. ..... 225/1; 225/103; 225/104; 30/120.2

(58) Field of Search ..... 225/103, 104, 225/105, 89; 30/120.2, 185, 241; 83/856, 857, 858

(56) References Cited

U.S. PATENT DOCUMENTS 1,094,698 A * 4/1914 Bostrom ..... 30/120.2
3,517,871 A * 6/1970 Gaffney et al. ..... 225/103
4,179,806 A * 12/1979 Lieptz ..... 30/124
4,409,843 A * 10/1983 Urban et al. ..... 73/851
4,964,555 A * 10/1990 Hnatuk ..... 225/93
5,038,475 A * 8/1991 Wolff ..... 30/124
5,118,021 A * 6/1992 Fiocchi ..... 225/103
5,634,272 A * 6/1997 Samuelson ..... 30/120.3
5,944,243 A * 8/1999 Weinstein ..... 225/93
6,474,525 B1 11/2002 Reitano ..... 225/1

* cited by examiner

*Primary Examiner*—Kenneth E. Peterson
*Assistant Examiner*—Omar Flores Sańchez
(74) *Attorney, Agent, or Firm*—Mark P. White

(57) ABSTRACT

A family of pill splitters is formed from a standard, substantially cylindrical lower body which contains a distinct bed for each one of a number of different complex pill shapes, and an upper body, integrally affixed to the lower body, which contains a pair of linear plunger guides slots. Each bed contains a recess having a cross section which substantially conforms to the pill shape, and the bed thickness is proportional to the thickness of the pill to be split. A long, thin cutting blade is affixed in proximity to the bed, and a bed support is formed in the lower body. A plunger with plunger guides slidingly engages the plunger guide slots. Each bed contains alignment tabs which engage the plunger guide slots to align the bed relative to the cutting blade.

15 Claims, 4 Drawing Sheets

FAMILY OF PILL SPLITTERS AND METHOD OF MANUFACTURE

BACKGROUND OF INVENTION

Pill splitters are common in the prior art, and are quite popular at the present time, especially because of the constantly increasing cost of prescription drugs, and the failure, or impossibility, of many users to obtain insurance which pays for much or all of their medication.

Many medications are marketed and priced in a variety of sizes in which the prices do not vary proportionately to the dosage. A pill splitter effective with Viagra pills, for instance, was the subject of U.S. Pat. No. 6,474,525. Viagra is marketed in three different dosages: 25, 50, and 100 mg, all three of which are sold at the same price. Thus, a user having a prescribed dosage of 50 mg. could halve the cost of his medication by purchasing half the number of 100 mg pills, and splitting them in half.

The present invention provides a family of pill splitters effective for splitting a number of pills which have different, complex shapes, and are thus problematic for use with prior art pill splitters. The invention further provides a method for economically manufacturing such a family, and for using a majority of common components.

Prior art pill splitters and cutters suffered from a number of failings. Among the most serious is the problem of contamination. When a single universal pill splitter is used to split a number of different pills, traces of the medication from one pill previously split can contaminate the medication contained in another pill split later. In the case when the medications in the two pills create an undesired, or contraindicated reaction, the result can present a danger to the person taking the pills. This can be especially problematic when two or more people in a household are using the same pill splitter. The problem is even greater in the event that pills split by such a universal splitter are to be taken by young children. Dosages for adults are drastically different than those for children, and even small amounts of the residue of an undesired medication remaining on the pill splitter can be life threatening to a young child.

A second problem with many pill splitters is that they do not accurately split a pill in equal parts, resulting in unequal and inaccurately calculated dosages.

The present invention provides a configuration which solves both these problems. A separate splitter is provided for each different pill, and cannot be used for any other pill because of the incorporation of a pill bed which conforms to a single pill shape and cannot, by design, be used for any other pill.

The present invention further provides a method for manufacturing this novel configuration, requiring only molded three parts: a body, a plunger, and a bed, the bed being unique for each different pill shape, but the remaining components being identical regardless of the pill shape.

SUMMARY OF INVENTION

It is an object of the present invention to provide a configuration which facilitates the manufacture of a family of pill splitters economically and with a minimum number of parts. It is a further object of the present invention to provide a method for manufacturing the family of pill splitters.

In accordance with one aspect of the present invention, the pill splitter includes a bed having a recess formed within, the recess having a cross section which substantially conforms to the pill shape, and a bed support formed in the lower body of the pill splitter on which the bed rests.

In accordance with another aspect of the invention, each bed further includes an upper face, a lower face, and edge supports for the pill, said edge supports formed in the lower face.

In accordance with a third aspect of the invention, a family of beds are included, each bed having a formed recess which accommodates a different specific complex pill shape.

In accordance with a forth aspect of the invention, each bed is substantially cylindrical in shape.

In accordance with a fifth aspect of the invention, each bed includes means for aligning the recess in the bed with a cutting blade in the body of the pill splitter.

In accordance with a sixth aspect of the invention, one or more guide tabs are formed in the bed which matingly engages linear plunger guide slots formed in the upper body of the pill splitter.

In accordance with a final aspect of the invention the cutting blade extends through the bed support, and wherein the bed includes a blade clearance relief which provides clearance between the cutting blade and the bed.

BRIEF DESCRIPTION OF DRAWINGS

These, and further features of the invention, may be better understood with reference to the accompanying specification and drawings depicting the preferred embodiment, in which.

DETAILED DESCRIPTION

The present invention is an improvement upon U.S. Pat. No. 6,474,525, by the same inventor as the current application. The present invention provides a means to create a series of pill splitters, each for different pill geometry, from a single basic design.

Figure 1A:
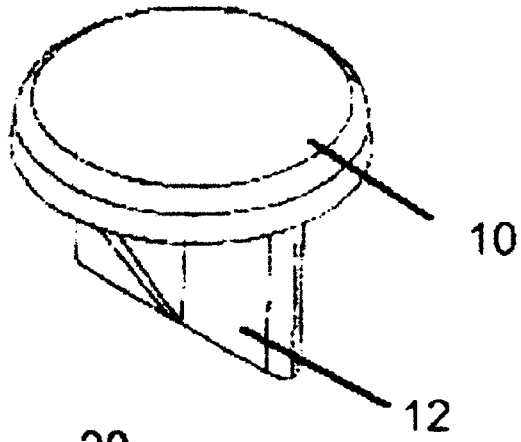
FIG. 1*a* depicts a perspective view of the pill-splitter plunger.
Figure 1B:
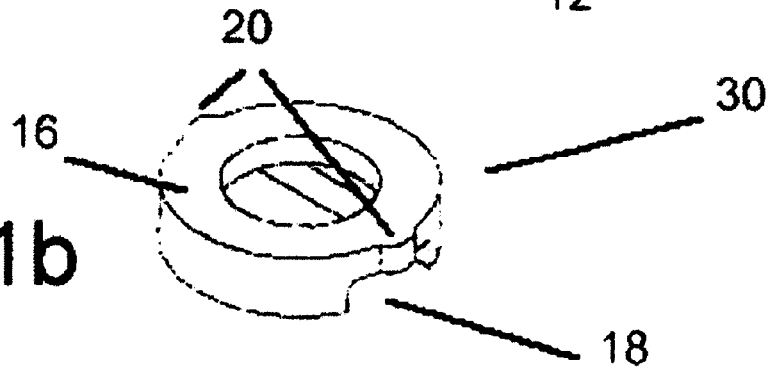
FIG. 1*b* depicts a perspective view of the pill-splitter bed.
Figure 1C:
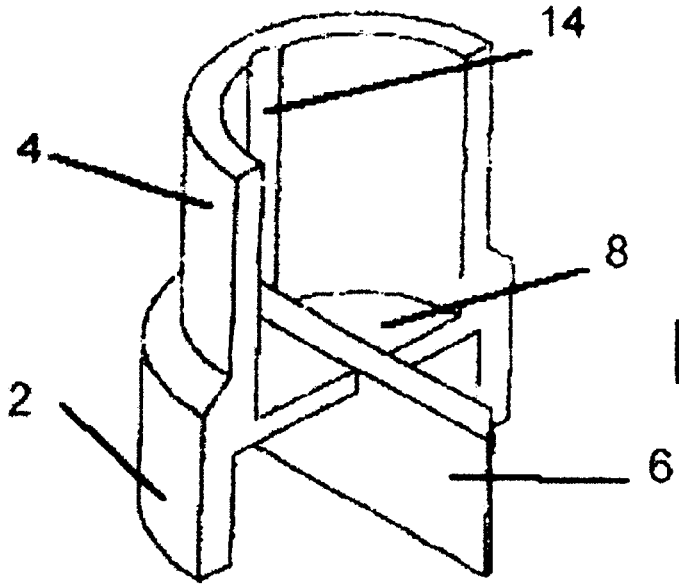
FIG. 1*c* depicts a cut-away perspective view of the pill splitter upper and lower body, with the cutting blade inserted in the lower body.
Figure 2A:
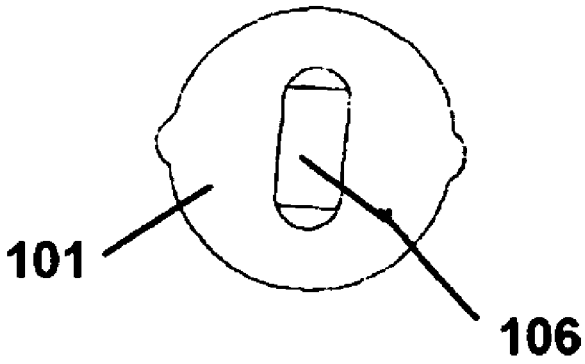
FIG. 2*a* depicts a top plan view of a pill splitter bed for a first pill type.
Figure 2B:
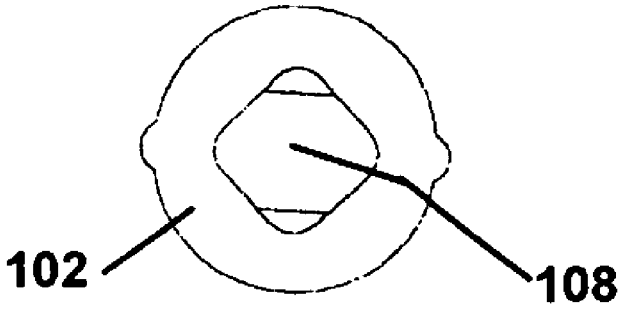
FIG. 2*b* depicts a top plan view of a pill splitter bed for a second pill type.
Figure 2C:
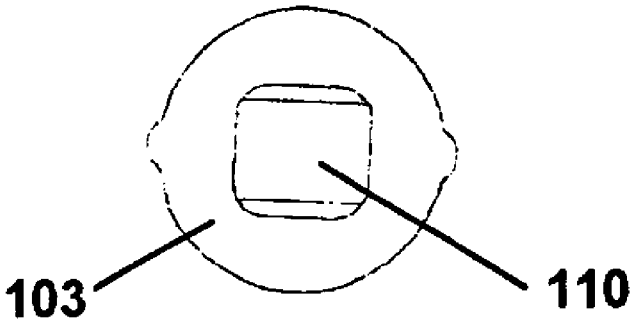
FIG. 2*c* depicts a top plan view of a pill splitter bed for a third pill type.
Figure 2D:
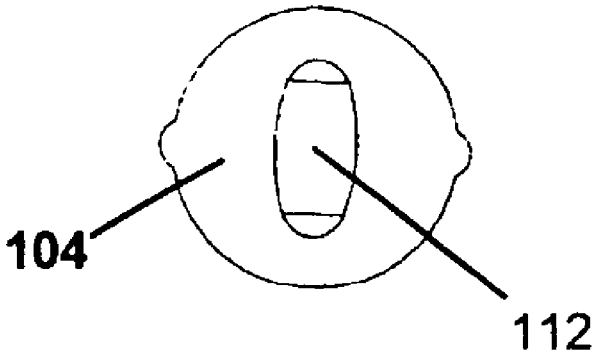
FIG. 2*d* depicts a top plan view of a pill splitter bed for a fourth pill type.

Referring first to FIGS. 1*a*, 1*b*, and 1*c*, a perspective view of the component parts of the present pill splitter is shown.

These include the plunger, which is similar to the plunger of the prior art, having a cap 10, and plunger body 12.

The splitter body, as depicted in FIG. 1*c*, is integrally formed into a lower body 2, and an upper body 4. Formed between the upper and lower bodies is the bed support 8, upon which the bed rests. The cutting blade 6 projects through the bed support 8.

Referring next to FIGS. 1*b* and 1*c*, the bed upper face 16 has two guide tabs 20 which mate with plunger guide slots 14, aligning the bed with the blade as a result. The cutting blade relief 18 allows the bed to be affixed to the bed support 8 without interfering with the cutting blade 8.

The bed is typically manufactured separately from the body, and then affixed to the bed support. Referring now to FIGS. 2*a* through 2*d*, beds for four different pill configurations are shown in top plan view. Each bed has an upper surface, 101, 102, 103, and 104, into which a recess 106, 108, 110, and 112 is formed which corresponds to the shape of the pill to be split. Each bed possesses a pair of guide tabs 20, as shown in FIG. 1*b*, which mate with the plunger guide slots, and maintain the cutting blade at right angles to the long dimension of the pill body, thus providing a clean, even cut, and producing two half-pills of identical size when the pill splitter is properly used.

Figure 3A:
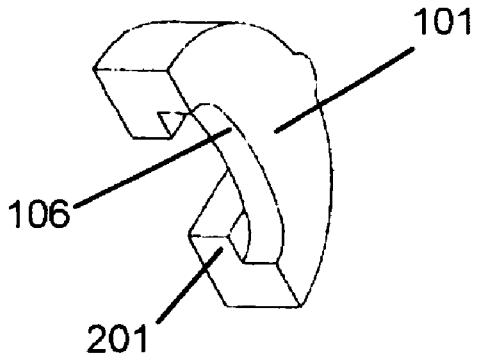
FIG. 3*a* depicts a cutaway view of a pill splitter bed for a first pill type.
Figure 3B:
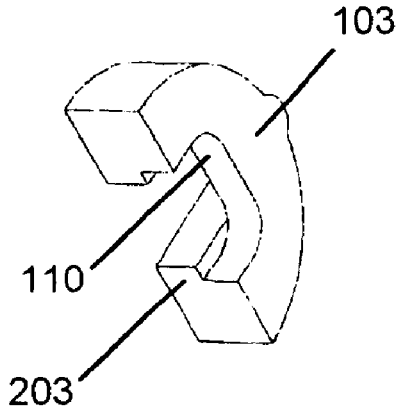
FIG. 3*b* depicts a cutaway view of a pill splitter bed for a second pill type.
Figure 3C:
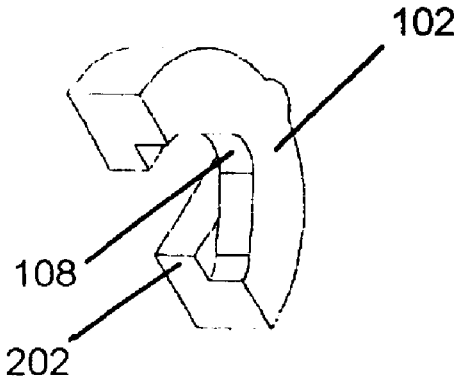
FIG. 3*c* depicts a cutaway view of a pill splitter bed for a third pill type.
Figure 3D:
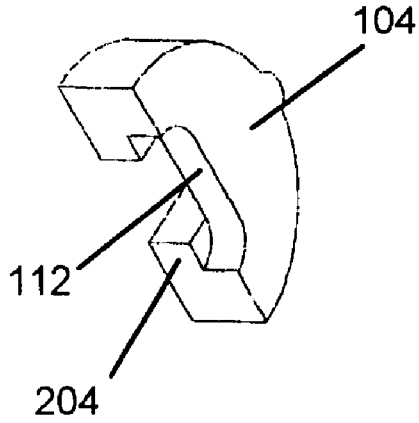
FIG. 3*d* depicts a cutaway view of a pill splitter bed for a fourth pill type.

FIGS. 3*a* through 3*c* depict a cut-away, perspective view of the four beds of FIGS. 2*a* through 2*d*, the surfaces being numbered identically. Edge supports 201, 202, 203, and 204 support the edges of the pills when they are disposed in the pill recesses 106, 108, 110, and 112. These edge supports also provide support for each bed relative to the lower body 2 of the pill splitter, as seen in FIG. 1*c*. The bottom of the edge support in each case forms a flat lower face surface parallel to the upper face of the bed. When the bed is disposed within the body of the pill splitter, the upper face is thus parallel to the bed support 8 of the splitter, as seen in FIG. 1*c*.

Figure 4A:
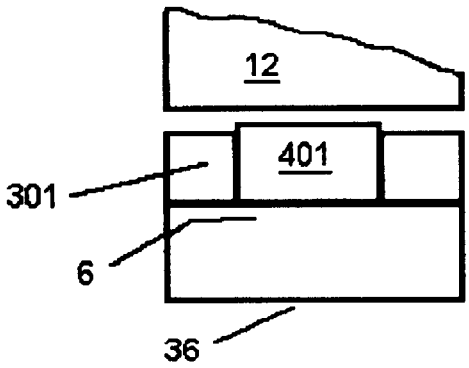
FIG. 4*a* depicts a cross section view of a splitter designed for a fifth pill type.
Figure 4B:
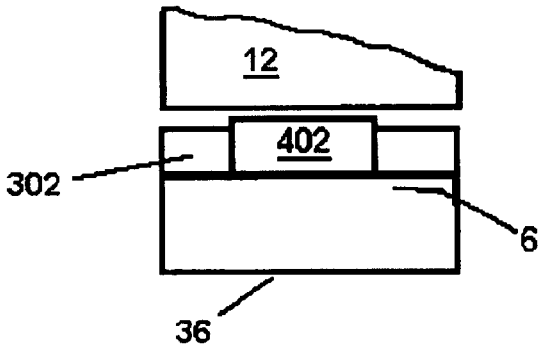
FIG. 4*b* depicts a cross section view of a splitter designed for a sixth pill type.

Referring now to FIGS. 4*a* and 4*b*, a cross section of the pill splitters designed for use with two drastically different pill shapes is shown. These figures do not depict all the elements of the cutter, but show only the positions of the pill beds relative to the cutting blades.

In FIG. 4*a*, fourfourthe plunger body 12 is poised above pill bed 301, in which pill 401 is inserted, just above cutting blade edge 6. It is further apparent that the plunger cannot descend farther than the upper face of the bed 301.

Referring now to FIG. 4*b*, a smaller pill 402 requires a thinner bed 302, although the height of the blade cutting edge 6 above the base 36 of the cutting blade is the same as in FIG. 4*a*. Note that the base of the cutting blade is coincident with the base of the pill splitter lower body, as can be seen in FIG. 1*c*. Thus, since the dimensions of the cutting blade are the same for all members of the family, the plunger body 12 descends further in FIG. 4*b* before it is stopped by the upper face of the bed 302 that in the configuration of FIG. 4*a*.

So long as the plunger body is long enough to descend to the upper surface of the thinnest pill bed of the family, which corresponds to the thinnest pill to be split, the same plunger may be used for every member of the family. In fact, the only component which varies from one member of the family to another is the pill bed.

Once the pill splitter is completely assembled, with the bed permanently affixed to the body of the splitter, its configuration is quite similar to the pill splitter of U.S. Pat. No. 6,474,525, which is incorporated herein by reference as to the sections entitled Description and Summary.

While the invention has been described with reference to specific embodiments, it will be apparent that improvements and modifications may be made within the purview of the invention without departing from the scope of the invention defined in the appended claims.

What is claimed is:

1. A method for manufacturing a family of pill splitters, each member of the family corresponding to a different pill shape, each member comprising (a) a bed having a recess formed within, the recess having a cross section which substantially conforms to the corresponding pill shape;

(b) a long, thin cutting blade, affixed in proximity to the bed;

(c) a lower body containing the bed;

(d) an upper body, integrally affixed to the lower body, and containing one or more linear plunger guides slots; and (e) a plunger, further comprising plunger guides which slidingly engage said plunger guide slots, each member of the family identical to each other member except for the pill bed, wherein the method comprises:

(i) manufacturing a separate bed for each member of the family; and (ii) permanently affixing each such bed in the lower body in proximity to the cutting blade, so that when a pill is placed in the recess of the corresponding bed, the bottom of the pill rests on the cutting edge of the blade.

2. The method of claim 1, where in each bed is substantially cylindrical.

3. The method of claim 2, wherein each bed further comprises means for aligning the recess in the bed with the cutting blade.

4. The method of claim 3, wherein the means for aligning the recess in the bed with the cutting blade farther comprises one or more guide tabs, and wherein the method further comprises matingly engaging the guide tabs with said linear plunger guide slots of the upper body.

5. The method of claim 4, wherein the lower body further comprises a bed support, and wherein the method further comprises affixing the bed to the bed support.

6. The method of claim 5, wherein each bed further comprises an upper face, a lower face, and edge supports for the pill, said edge supports formed in the lower face.

7. The method of claim 6, wherein the cutting blade extends through the bed support, and wherein the bed further comprises a blade clearance relief which provides clearance between the cutting blade and the bed.

8. The method of claim 7, wherein each different pill bed has a thickness which varies with the size of the pill to be split by the bed.

9. A pill splitter comprising:

a bed, further comprising a periphery, and having a recess formed within, the recess having a cross section which substantially conforms to the pill shape;

a long, t cutting blade, affixed below the bed, and protruding into the recess, but enclosed by the periphery and by an upper surface of the bed;

a lower body;

a bed support formed in the lower body on which the bed rests;

an upper body, integrally affixed to the lower body, and containing one or more linear plunger guides slots; and a plunger, further comprising plunger guides which slidingly engage said plunger guide slots.

10. The pill splitter of claim 9, wherein each bed is substantially cylindrical.

11. The pill splitter of claim 10, wherein each bed further comprises means for aligning the recess in the bed with the cutting blade.

12. The pill splitter of claim 11, wherein the means for aligning the recess in each bed with the cutting blade further comprises one or more guide tabs, and wherein the guide tabs matingly engage the guide tabs with said linear plunger guide slots of the upper body.

13. The pill splitter of claim 12, wherein the cutting blade extends through the bed support, and wherein the bed further comprises a blade recess which provides clearance between the cutting blade and the bed.

14. The pill splitter of claim 13, wherein each bed further comprises an upper face, a lower face, and edge supports for the pill, said edge supports formed in the lower face.

15. The pill splitter of claim 14, wherein each different pill bed has a thickness which varies with the size of the pill to be split by the bed.

* * * * *